US006377289B1

(12) United States Patent
Philebrown et al.

(10) Patent No.: US 6,377,289 B1
(45) Date of Patent: Apr. 23, 2002

(54) MODULAR PRINTHEAD

(75) Inventors: Peter Philebrown, Kanata; Theodore A. Bellisario, Milton, both of (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/750,409

(22) Filed: Dec. 28, 2000

(51) Int. Cl.[7] ..... B41J 2/415
(52) U.S. Cl. ..... 347/127; 347/152
(58) Field of Search ..... 347/123, 127, 347/128, 152

(56) References Cited

U.S. PATENT DOCUMENTS 5,278,588 A 1/1994 Kubelik ..... 346/159
5,404,157 A * 4/1995 Hosaka et al. ..... 347/128

OTHER PUBLICATIONS

Philebrown, Peter "Electron Beam Imaging Enhancement through the application of Thin Film Technology", IS&T's 49th Annual Confrence, Nov. 1997.

* cited by examiner

*Primary Examiner*—Joan Pendegrass
(74) *Attorney, Agent, or Firm*—Lahive & Cockfield, LLP

(57) ABSTRACT

A modular printhead is disclosed having the ability to separate, leaving a first collection of predetermined layers relatively permanently affixed to a print engine while a second collection of predetermined layers resides in a relatively disposable component thereof. The modular printhead includes a first printhead component having at least a first electrode and a second electrode. There is additionally a second component of the printhead. The second component can have a third electrode. The first printhead component of the printhead demountably presses against the second component, held in place by at least one fastening mechanism.

15 Claims, 3 Drawing Sheets

MODULAR PRINTHEAD

FIELD OF THE INVENTION

The invention relates to a printhead suitable for use with image forming systems, and more particularly relates to a modular printhead arrangement.

BACKGROUND OF THE INVENTION

Different printhead technologies in use today in image forming systems create and reproduce images in different ways. Some of these technologies include a process of charging a dielectric layer on a surface of a drum with an electronic image. A developer then transfers developer material, such as toner particles, to the charged surface. Rollers then press a printing medium, such as a sheet of paper, against the developed toner particles to permanently affix the toner particles to the paper sheet.

An alternative arrangement provides a photoconductive member within the imaging device charged to a substantially uniform potential. The light image of a document projects onto the photoconductive member, dissipating the charge on selected areas of the photoconductive member. The dissipation of charge results in an electrostatic image forming on the photoconductive member, which corresponds to a particular image on a document. A similar process develops a toner particle image and transfers it to a paper sheet.

One specific type of image forming system is an electrostatographic image system. Such image forming systems typically include at least one image forming device, such as a printhead. A known configuration for a printhead is a three layer structure. A first layer is an electrode layer, a second layer is a dielectric layer, and a third layer is another electrode layer. Electrodes within each of the electrode layers cross with electrodes from the other of the electrode layers, forming intersections, physically separated by the dielectric layer. These electrode intersections form charge generation sites.

Current printhead technology has resulted in a combination of layers, in addition to the basic three layers, to form the printhead. Some of the added layers are relatively expensive, causing the cost for the overall printhead to exceed that which is supported by the marketplace.

SUMMARY OF THE INVENTION

There exists in the art a need for a modular printhead having the ability to separate a first collection of predetermined layers relatively permanently affixed to a print engine from a second collection of predetermined layers residing in a relatively disposable component thereof.

A modular printhead, according to one aspect, includes a first printhead component having at least a first electrode, a second electrode. A second component of the printhead can have a third electrode. The first printhead component of the printhead is separable from the second component and couples thereto in a removable and replaceable manner. A fastening mechanism or mounting element can press the components together, holding them in position.

The first electrode is an RF-line, or drive, electrode or electrode array, the second electrode is a finger electrode or electrode array, and the third electrode is a screen electrode or electrode array, in more common configurations and according to the teachings of the present invention. The first printhead component further includes a dielectric layer, to electrically insulate the first electrode (RF-line electrode) from the second electrode (finger electrode). A number of different materials can form the dielectric layer, including semi-conductor materials.

A spacer layer separates the second electrode and the third electrode in accordance with further aspects of the present invention. Mounting blocks mount the third electrode in place.

BRIEF DESCRIPTION OF THE DRAWINGS

The aforementioned features and advantages, and other features and aspects of the present invention, will become better understood with regard to the following description and accompanying drawings, wherein.

DETAILED DESCRIPTION OF THE INVENTION

The present invention generally relates to a modular printhead mounted within an image forming system. A characteristic of the modular printhead is that there exists at least two components of the printhead structure. A first printhead component contains several layers contributing to the formation of the printhead that share one or more common characteristics. The first printhead component, for example, can contain a layer or layers that are generally less expensive than a second layer or layers found in the second component of the printhead. The second component of the printhead mounts in the print engine and contains components that should not need to be replaced during the life of the image forming system. The first printhead component can include parts that are less costly to replace, and are disposable as necessary. More specifically, when components within the first printhead component of the printhead wear out, a user removes the first printhead component and replaces it with a like component to restore printhead function. This procedure leaves the second component in tact in the print engine of the image forming system. Such an arrangement results in a printhead that is more easily maintained and is relatively less costly to the owner of the image forming system.

Figure 1:
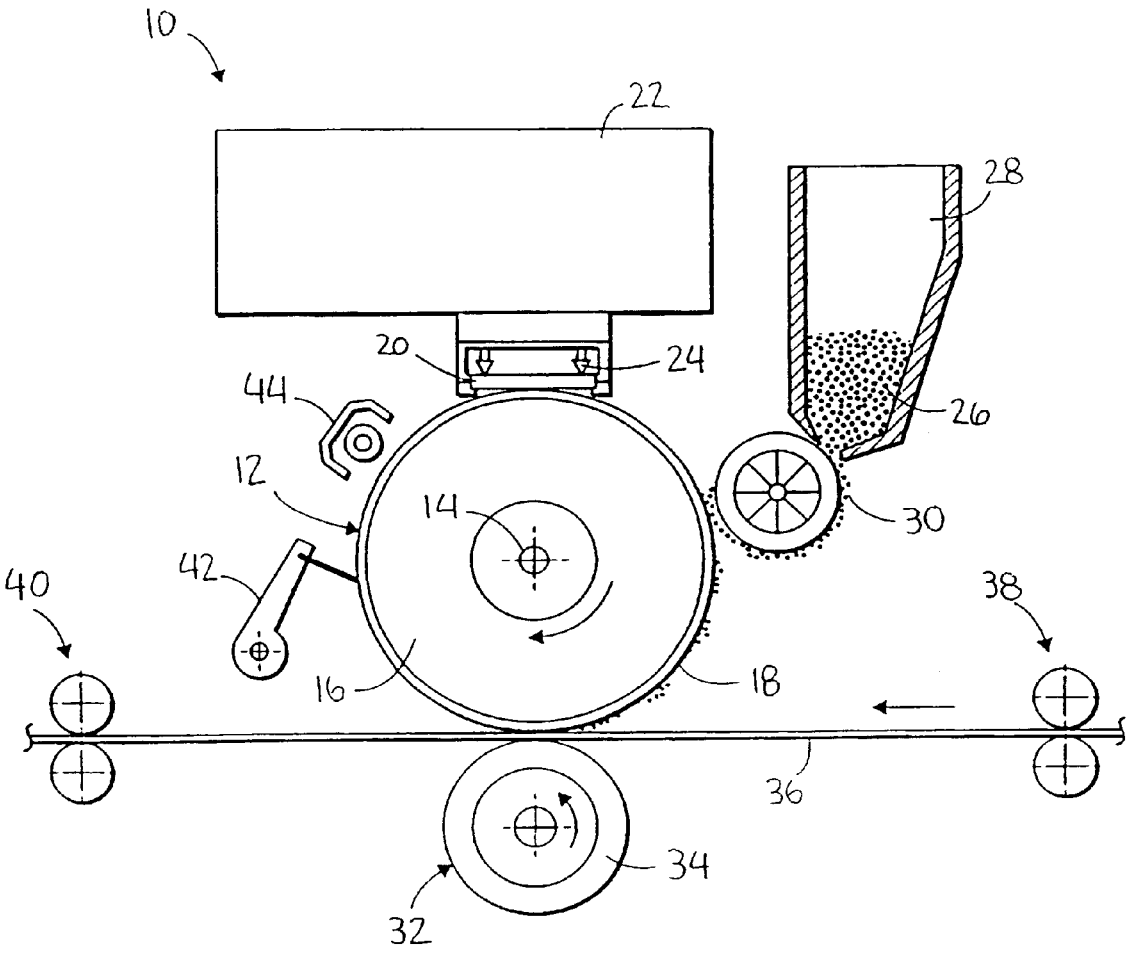
FIG. 1 is a diagrammatic illustration of an image forming system.
Figure 2:
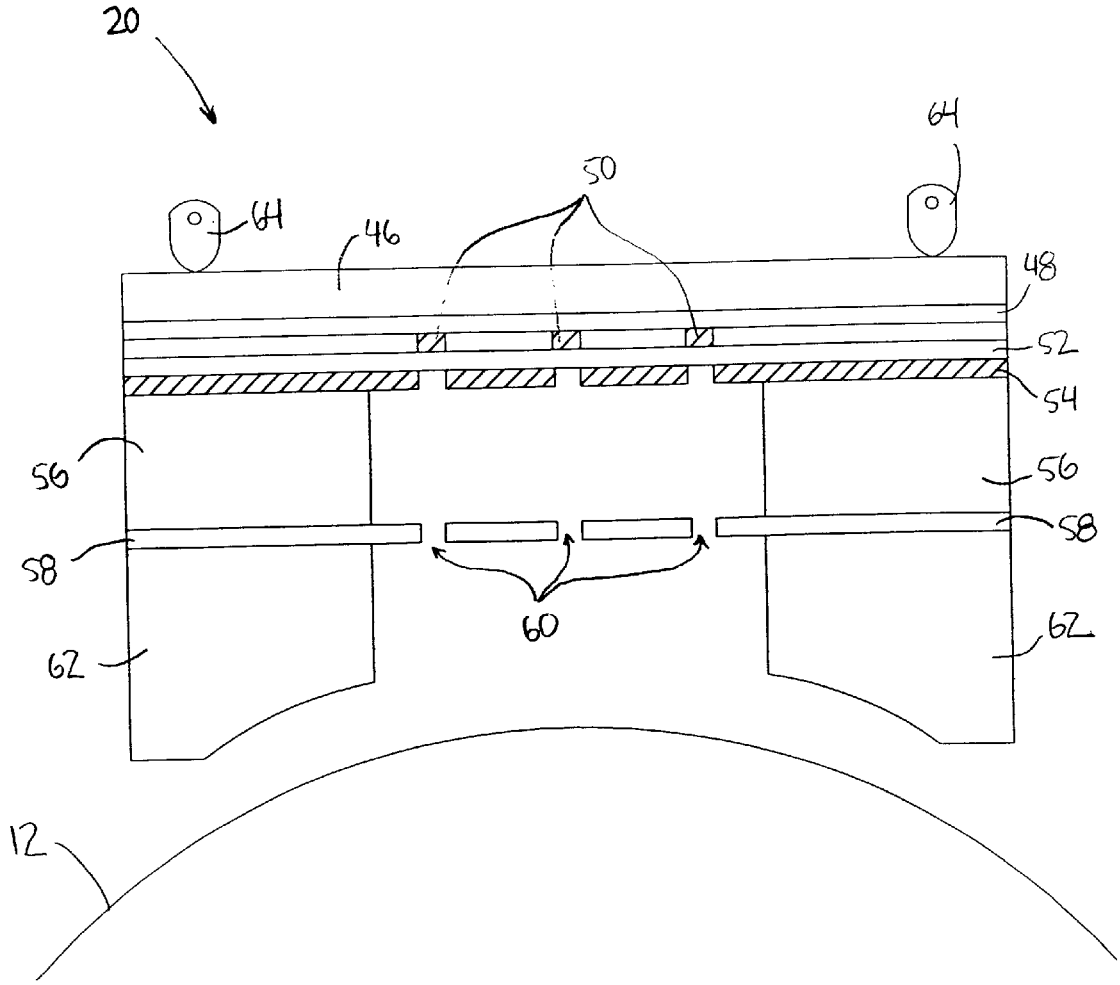
FIG. 2 is a diagrammatic illustration of a printhead suitable for use in the image forming system of FIG. 1, according to the teachings of the present invention.
Figure 3:
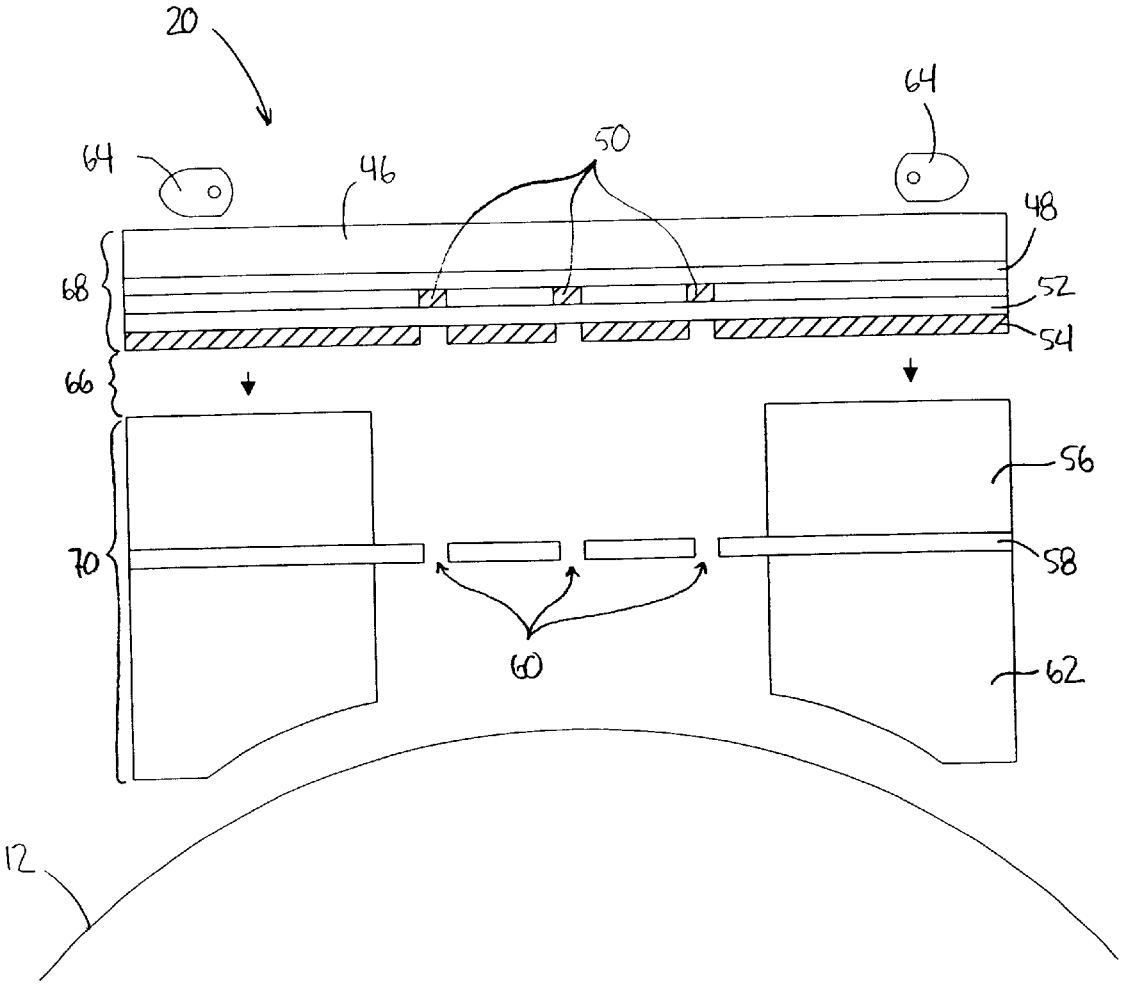
FIG. 3 is a diagrammatic illustration of the printhead of FIG. 2, illustrating the separation of selected components.

Referring now in detail to the figures wherein like parts are designated by like reference numerals throughout, FIGS. 1 through 3 illustrate an example embodiment of a modular printhead according to the teachings of the present invention. Although the present invention will be described with reference to the example embodiments illustrated in the figures, it should be understood that the present invention can be embodied in many alternative forms. In addition, any suitable size, shape, or type of elements or materials can be utilized.

The image forming system illustrated is shown solely for the purpose of providing a general structure in which the present invention can reside. One skilled in the art will understand that other image forming systems, or charge transfer apparatus can be utilized in combination with different embodiments of the present invention, without departing from the spirit and scope of the invention herein. Image forming systems, for example, can include a collection of different technologies, such as electrophotographic, electrostatic, electrostatographic, ionographic, acoustic, inkjet, and other types of image forming or reproducing systems that are adapted to capture and/or store image data associated with a particular object, such as a document, and reproduce, form, or produce an image.

FIG. 1 illustrates an image forming system 10 that can have a drum 12 that mounts for rotation about an axis 14. The drum 12 incorporates an electrically conductive core 16 coated with a dielectric layer 18. An alternative structure, known to those of ordinary skill in the art and therefore not shown herein, provides a wide belt supporting the dielectric layer and rotating around several wheel mechanisms.

The dielectric layer 18 receives a charged image from a printhead 20. Electrical connectors 24 connect a controller 22, which drives the printhead 20 as desired. As the drum 12 rotates in the direction of the arrow shown around the axis 14, charge generation sites within the printhead 20 generate the charged image and transfer the image to the dielectric layer 18 on the outer surface of the drum 12. The drum 12 continues to rotate as a hopper 28 feeds toner particles 26 through a feeder 30 to the charged portion of the dielectric layer 18. The toner particles 26 electrostatically adhere to the charged image on the dielectric layer 18, developing the charged image into a toner image. The rotating drum 12 then carries the toner image towards a nip formed with a pressure roller 32. The pressure roller 32 has an outer layer 34 positioned in the path of a receptor, such as a paper sheet 36. The paper sheet 36 enters between a pair of feed rollers 38. The pressure in the nip is sufficient to cause the toner particles 26 to transfer to the paper sheet 36, permanently affixing the toner particles 26 thereto. The paper sheet 36 continues through and exits between a pair of output rollers 40. After passing through the nip between the drum 12 and the pressure roller 32, a scraper blade assembly 42 removes any toner particles 26 that may remain on the dielectric layer 18. A discharge head 44 positioned between the scrapper blade assembly 42 and the printhead 20 removes any residual charge remaining on the dielectric layer 18 surface. The process repeats for the next image.

FIG. 2 illustrates a unique printhead 20 configuration according to the teachings of the present invention. The printhead 20 has a series of different layers. There is a backbone 46 at one end, which serves as a base support for the printhead 20. The backbone 46 can be made of a number of different materials including, e.g., plastics, composites, or other like materials able to structurally support the pressures placed on the printhead 20 during operation. A substrate 48 layer adheres to the backbone 46. The substrate 48 provides a support structure for the RF-line electrodes 50. A dielectric layer 52 separates the RF-line, or drive, electrodes 50 from a layer of finger electrodes 54. The dielectric layer, or dielectric composition, as disclosed herein includes a number of different structures and materials. The dielectric, for example, can be a single layer of a single material, or a plurality of layers of either the same or differing dielectric materials. A plethora of compositions can form the dielectric. Some possible materials include silicon dioxide, aluminum oxide, magnesium oxide, silicon nitride, and boron nitride.

As viewed from a point in space generally orthogonal to the plane containing each of the electrode layers, the RF-line electrodes 50 form intersections with the finger electrodes 54. However, the electrodes 50 and 54 are physically separated, and electrically insulated from each other, by at least one dielectric layer 52 or composition, as viewed from a cross-sectional perspective of the printhead film containing the electrode and dielectric layers.

The finger electrodes 54 are adjacent a spacer 56, which maintains a desired distance between the finger electrodes 54 and a screen electrode layer 58. A set of mounting blocks 62 mount to the screen electrode 58, completing the modular printhead 20. The screen electrode 58 has within it a series of screen holes 60 in alignment or registration with the intersections of the RF-line electrodes 50 and the finger electrodes 54.

The spacer 56 and the screen electrode 58 are not requirements of the modular printhead 20. In the embodiment illustrated, they do form a substantial portion of the second printhead component 70. However, the second printhead component 70 can be formed from other layers within the printhead 20 as further discussed below.

FIG. 3 illustrates the printhead 20 according to one aspect of the present invention, split into two separable and connectable components 68 and 70. The backbone portion 46 of the first printhead component 68 supports the substrate layer 48. The RF-line electrodes 50 mount on the substrate 48 layer. The dielectric layer 52 electrically insulates RF-line electrodes 50 from the finger electrodes 54. This first group of layers forms the removable and replaceable first printhead component 68. Between the removable and replaceable first printhead component 68 and the spacer 56 is a gap 66. This gap 66 represents the splitting point between each of the printhead components 68 and 70.

The spacer 56 of the second printhead component 70 supports the screen electrode 58, which mounts thereto with the mounting blocks 62. The screen electrode 58 includes screen holes 60 in registration with the intersections of the RF-line electrodes 50 and the finger electrodes 54. The spacer 56, the screen electrode 58, and the mounting blocks 62 form the second printhead component 70.

The collection of layers that form each of the illustrated components 68 and 70 is not restricted to the embodiment illustrated herein. The printhead 20 can separate at several different locations, depending on the various motivations for utilizing the modular feature, and can contain a different number and type of layers. A significant advantage of the printhead 20 of the invention is the relatively low cost achieved by separating the printhead 20. The more expensive and longer lasting layers are in the semi-permanent second printhead component 70, while the less expensive layers are in the removable, replaceable, and disposable first printhead component 68. A cost efficiency results by placing the less costly layers of the printhead 20 that have shorter life spans or need to be cleaned more often in the removable and replaceable first printhead component 68. The user must replace only the less costly portion of the printhead 20 in order to achieve an extended printhead life.

An electroforming process, as understood by one of ordinary skill in the art and therefore not further discussed herein, can form the thick film that forms the screen electrode 58 in the illustrated embodiment. The electroforming process is a method of achieving the thickness required for spanning between the overall width of the printhead 20, while concomitantly achieving the required accuracy to place the screen holes 60 in line with the RF-line electrode 50 and finger electrode 54 intersections. If the electroformed thick film were in the disposable component of the printhead 20, the cost would be prohibitive for the targeted user. However, the second printhead component 70 is semi-permanently fixed in the printing engine and is not typically discarded with the first printhead component 68. This allows for the use of more expensive, higher quality, longer lasting elements.

The spacer 56, as viewed in FIG. 3, is the next largest contributor to charge output variation. Therefore, control of the thickness of the spacer 56 is a significant factor in the design of printheads. According to aspects of the present invention, the spacer 56 permanently attaches to the engine mounted screen electrode 58. The spacer 56 can be formed of high precision materials, such as glass, ceramic, and the like. The relative high cost of these materials is justified by semi-permanently mounting the spacer 56, and hence the second printhead component 70, in the print engine. This results in a higher quality print output, and therefore a better overall printhead.

The foregoing components 68 and 70 can be assembled in a removable and replaceable manner to form the modular printhead 20 of the present invention. For example, a retaining mechanism, such as retaining cams 64, can rotate to press the first and second printhead components 68 and 70 together in locking fashion (see FIG. 2). The retaining cams 64 can rotate in an opposite direction to release the first and second printhead components 68 and 70 (see FIG. 3). The modular design of the printhead 20 provides for relatively easy maintenance. A user can remove the first printhead component 68 of the printhead 20 from the second printhead component 70 to gain access to screen holes 60 for maintenance and cleaning. This extends the life of the screen electrode 58, and maintains good print quality. Further, the rigidity of the thick film screen electrode 58 allows for easy cleaning of the screen electrode 58. This is not possible with thin film screens utilized in other printhead applications, which are instead replaced. Corona bi-products can also be removed from the finger electrodes 54, which are exposed when the first printhead component 68 and second printhead component 70 of the modular printhead 20 separate.

In addition to the improved access to the screen holes 60 and the finger electrodes 54, the printhead 20 is relatively less expensive to construct because it has a simpler design. More specifically, in the illustrated printhead 20, there are no additional layers above the finger electrode 54 layer, which simplifies the manufacturing process. Furthermore, arranging the screen electrode 58 and the spacer 56 within the machine places the more costly elements of the printhead on the more permanent print engine, which is designed to last the life of the image forming system 10.

Numerous modifications and alternative embodiments of the invention will be apparent to those skilled in the art in view of the foregoing description. Accordingly, this description is to be construed as illustrative only and is for the purpose of teaching those skilled in the art the best mode for carrying out the invention. Details of the structure may vary substantially without departing from the spirit of the invention, and exclusive use of all modifications that come within the scope of the appended claims is reserved. It is intended that the invention be limited only to the extent required by the appended claims and the applicable rules of law.

What is claimed is:

1. A modular printhead, comprising:

a first printhead component;

a separable screen component, wherein said first printhead component is configured to be removably and replaceably coupled with said screen component to form said modular printhead, said screen component having a spacer mounted with a screen electrode; and a mounting element for pressing said first printhead component against said screen component so as to hold said first printhead component in place when assembled.

2. The modular printhead of claim 1, wherein said first printhead component comprises a first electrode layer, a dielectric layer, and a second electrode layer.

3. The modular printhead of claim 1, wherein said mounting element comprises at least one retaining cam.

4. The modular printhead of claim 1, wherein at least one of said first printhead component is disposable.

5. The modular printhead of claim 1, wherein said first printhead component further comprises at least one RF-line electrode layer, at least one dielectric layer, and at least one finger electrode layer.

6. In an image forming system, a modular printhead, said printhead comprising:

a first printhead component having at least a first electrode layer and a second electrode layer;

a second component having at least a third electrode layer; and means for pressing together said first and second components to form said modular printhead.

7. The modular printhead of claim 6, wherein said first electrode comprises one or more RF-line electrodes.

8. The modular printhead of claim 6, wherein said second electrode comprises one or more finger electrodes.

9. The modular printhead of claim 6, wherein said third electrode comprises one or more screen electrodes.

10. The modular printhead of claim 6, wherein said first printhead component further comprises a dielectric layer electrically insulating said first electrode from said second electrode.

11. The modular printhead of claim 6, wherein said second component further comprises a spacer layer disposed between said second electrode and said third electrode.

12. The modular printhead of claim 6, wherein said second component further comprises one or more mounting elements for retaining said third electrode in place.

13. The modular printhead of claim 6, wherein said means for pressing comprises at least one mounting element.

14. The modular printhead of claim 13, wherein said mounting device comprises at least one retaining cam.

15. The modular printhead of claim 6, wherein said first printhead component is removably and replaceably coupled to said second component during use.

* * * * *